US008356382B2

(12) United States Patent
Zeitlin

(10) Patent No.: US 8,356,382 B2
(45) Date of Patent: Jan. 22, 2013

(54) KNIFE SWIPER

(76) Inventor: Eric S. Zeitlin, Baldwin, NY (US)

( * ) Notice: Subject to any disclaimer, the term of this patent is extended or adjusted under 35 U.S.C. 154(b) by 321 days.

(21) Appl. No.: 12/791,998

(22) Filed: Jun. 2, 2010

(65) Prior Publication Data

US 2010/0307008 A1 Dec. 9, 2010

Related U.S. Application Data

(60) Provisional application No. 61/217,790, filed on Jun. 4, 2009.

(51) Int. Cl.
*A47L 21/04* (2006.01)

(52) U.S. Cl. ..... 15/236.09; 15/218.1; 15/236.06; 15/246; 30/123; 30/128

(58) Field of Classification Search ..... 15/210.1, 15/218, 218.1, 220.4, 229.11, 229.13, 236.01, 15/236.05–236.09, 244.1, 245, 246; 30/123, 30/128–130

See application file for complete search history.

(56) References Cited

U.S. PATENT DOCUMENTS

| | | | | | |
|---|---|---|---|---|---|
| 1,281,394 | A | * | 10/1918 | Kennedy | 15/218 |
| 1,491,623 | A | | 4/1924 | Pitchur | |
| 1,934,556 | A | * | 11/1933 | Pelz | 15/245 |
| 2,140,209 | A | * | 12/1938 | Rietveld | 15/236.09 |
| 2,148,009 | A | * | 2/1939 | Bing | 15/100 |
| 2,256,650 | A | * | 9/1941 | Reid et al. | 15/245 |
| 2,280,225 | A | * | 4/1942 | Finely | 15/245 |
| 2,525,341 | A | * | 10/1950 | Eicher | 15/245 |
| 2,719,313 | A | * | 10/1955 | Smith | 15/118 |
| 2,729,434 | A | * | 1/1956 | Walden | 366/343 |
| 3,094,730 | A | * | 6/1963 | Schwarz | 15/218.1 |
| 4,085,478 | A | * | 4/1978 | Bailes et al. | 15/245 |
| 4,361,926 | A | * | 12/1982 | Brush et al. | 15/236.09 |
| 5,860,182 | A | * | 1/1999 | Sareyani | 15/114 |
| 6,733,056 | B2 | | 5/2004 | Daniele | |

FOREIGN PATENT DOCUMENTS

| | | | |
|---|---|---|---|
| JP | 8-150110 | * | 6/1996 |
| JP | 2002000970 | | 1/2002 |
| JP | 2006130278 | | 5/2006 |

* cited by examiner

*Primary Examiner* — Mark Spisich

(57) ABSTRACT

A removably attachable, multifunctional Knife Swiper (10) for a utensil such as a kitchen knife is provided comprising a handle (20), an arm (30), and a wiper (40). The device is shaped in such a fashion as to have minimal effect on normal cutting behavior, and provides several benefits to the user, such as providing means to quickly and more safely remove food remnants stuck to the blade of the knife, and providing means for the user to place a knife with a Knife Swiper attached to it down on a surface so that the knife rests with its blade elevated off the surface.

2 Claims, 7 Drawing Sheets

FIG. 6A TOP VIEW
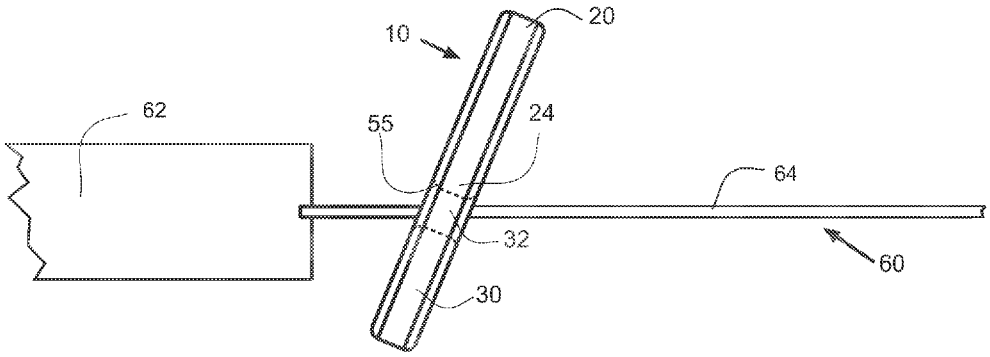
FIG. 6B
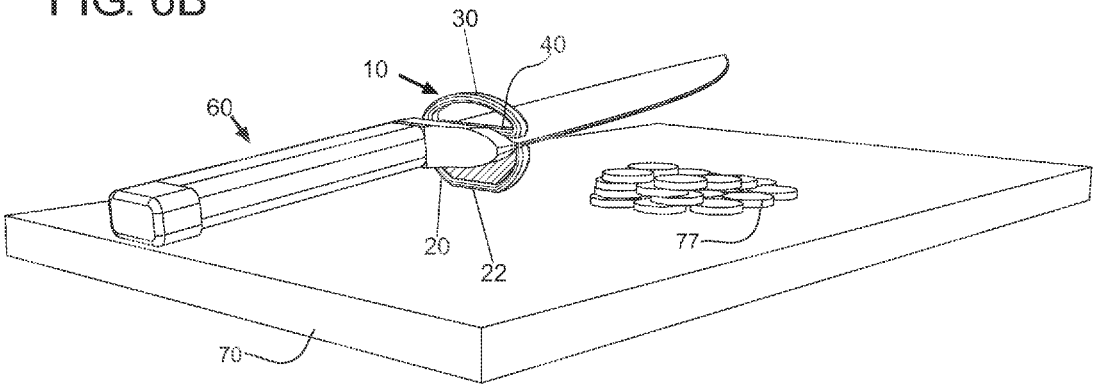

KNIFE SWIPER

This application claims priority from Provisional Patent Application #61/217,790 Confirmation #2433 Date Filed: Jun. 4, 2009

CROSS REFERENCE TO RELATED APPLICATIONS

Provisional Pat. App. #61/217,790 Confirmation #2433

FEDERALLY SPONSORED RESEARCH

N/A

SEQUENCE LISTING OR PROGRAM

N/A

BACKGROUND OF THE INVENTION

1. Field of Invention

This invention relates to knife accessories, particularly to a removably attachable knife cleaner and knife rest that is used in conjunction with a knife or other utensil to help make food preparation faster, easier, safer, and cleaner.

2. Prior Art

During the process of cutting food into smaller pieces with a kitchen knife, food remnants may stick to the knife blade. People often remove the food remnants by running their fingers along the sides of the blade, which is dangerous, and deposits food particles, oils, and residue onto the user's fingers, causing them to smell like the food they are cutting, and may also be detrimental to their health, for example with bacteria from raw meats or irritating oils from onions or peppers, which may cause infection or painful irritation.

Additionally, when a knife is placed down on a surface such as a counter-top after cutting food, residue may be transferred from the blade to the counter-top, requiring extra cleanup. Dirt and germs may similarly be transferred from the counter-top to the knife blade, which may contaminate food that is later cut by that knife. Further, because the knife is resting on its side, it can be difficult to pick up quickly for subsequent use, since it requires certain dexterity to pick up a knife that is resting on its side. This adds unnecessary time and effort to the food preparation process.

Some devices address the problem of cut-up food sticking to a knife blade. Santoku knives have scalloped release patterns on their blades to aid the release of thin slices of food sticking to the blade after slicing. However, they do not always work effectively in this manner. Japanese patent publication JP2002000970 to Isao teaches a guide member that is magnetically attached to the blade of a kitchen knife. This device, however, may get in the way of slicing certain foods, and may be inadvertently pushed upwards on the blade during use. The application does not mention sliding the device along a blade to remove food remnants, nor does it provide a safe and efficient means to do so.

Additionally, Progressive International currently sells a product called "Knife Pro" which "removes excess food from the knife blade with one smooth swipe so you can keep on cutting." The Knife Pro rests on a countertop, and the knife blade is run through it to remove stuck-on food from the blade. This device takes up valuable counter space, and is not convenient to use.

Japanese patent publication number JP2006130278 to Shunichi discloses a squeegee attached to a knife blade, whereby "it becomes possible to rub off from a cutting board more quickly to accuracy" into a bowl. The Shunichi device has several flaws that make it ineffective for the task it aims to perform. For example, it doesn't allow the user to cut food with a knife at a natural angle, since a right-handed user will often hold a knife and slice food at an acute angle on the right hand side, between the knife blade and the cutting surface (it is similar for left-handed users on the left-hand side of a knife blade). The Shunichi application does not mention scraping food off a knife by sliding the device along a blade, nor is it suited for such use, from a practical and safety perspective. Finally, the Shunichi application does not mention using the device to hold a knife upright, nor would it work effectively in that manner.

U.S. Pat. #1,491,623 to Pitchur shows a device used to keep a knife blade off a surface. It would, however, adversely affect cutting food with the knife while it was attached. Lastly, U.S. Patent Application #20090223060 to Zeitlin shows a removably attachable accessory for a kitchen knife which requires magnetic means to hold it on the knife and works differently than the present invention.

While the prior art addresses some of the problems associated with food preparation, none of these products take all of the criteria into consideration and provide a single Knife Swiper which provides a useful and convenient cleaner and rest for knives.

BACKGROUND OF THE INVENTION

Objects And Advantages

Accordingly, several objects and advantages of the present invention are:

(a) to provide a Knife Swiper that facilitates faster, easier, cleaner, safer, and more sanitary removal of cut-up food stuck to a knife blade after cutting food;

(b) to provide a Knife Swiper that facilitates faster, easier, and more sanitary food preparation by providing means for elevating a knife blade off surfaces between use;

(c) to provide a Knife Swiper that works effectively with many shapes, sizes, and styles of knives, is easy to use by people with different cutting styles, and does not interfere with the process of cutting and slicing while it is being used.

Further objects and advantages will become apparent from a consideration of the ensuing description and drawings.

SUMMARY

In accordance with the present invention, a removably attachable Knife Swiper for a kitchen knife or other utensil is provided comprising a handle with an opposing shoulder, an arm protruding downwards from the shoulder, and a vertical wiper extending upwards from the bottom of the arm via a connector. The device is shaped in such a fashion as to have a minimal effect on normal cutting behavior when the present invention is attached to a knife.

The present invention allows the user to quickly, easily, cleanly, and safely remove food remnants that may get stuck on a knife blade while cutting food. By sliding the present invention lengthwise along the blade of a knife, it removes food remnants stuck to the blade after cutting. The current method typically entails the user dangerously sliding their finger along the blade to remove the food remnants, washing the remnants off the knife at the sink, or scraping the blade along the edge of a cutting board. The present invention also allows the user to place a knife down between use in a safer, cleaner, and more easily accessible position. When the device is attached to a knife, the user may place the knife down on a surface such as a counter-top, whereby the blade is held in a manner that keeps it elevated off the surface, in a position that is much cleaner and easier to pick up for further use.

DRAWINGS—FIGURES

In the drawings, closely related figures have the same number but different alphabetic suffixes.

FIG. 6A shows a top view of the present invention removably attached to a knife, showing how the present invention can be tilted forward or back during use and not bind on the knife, due to Straight Bottom 32 and fillets 55.

FIG. 6B shows a perspective view of a knife with the present invention removably attached to it, resting on a surface (here a cutting board) with its blade elevated off of and not touching the surface.

REFERENCE NUMERALS

10—Knife Swiper
11A—Alternative Embodiment A
11B—Alternative Embodiment B
11C—Alternative Embodiment C
11D—Alternative Embodiment D
20—Handle
21—Upwardly Extending Handle
22—Handle Indentation
23—Outer Bottom Portion of Handle 20
24—Handle Wiper
26—Finger Recess
27—Outer Handle Ridge
28—Embossed Logo
29—Grip Assistors
30—Arm
31—Shoulder
32—Straight Bottom of Shoulder
33—Wide Upper Arm
34—Straight Arm
36—Gap
38—Connector
39—Outer Bottom Portion of Arm 30
40—Wiper
42—Rounded top of Wiper (40)
50—Knife Entrance
52—Handle Entrance
53—Arm Entrance
55—Fillets
60—Knife
62—Knife Handle
64—Knife Blade
70—Cutting Board or other surface
76—Food Remnants
77—Pile of Cut Food

DETAILED DESCRIPTION

Preferred Embodiment

FIGS. 1-1A

Figure 1:
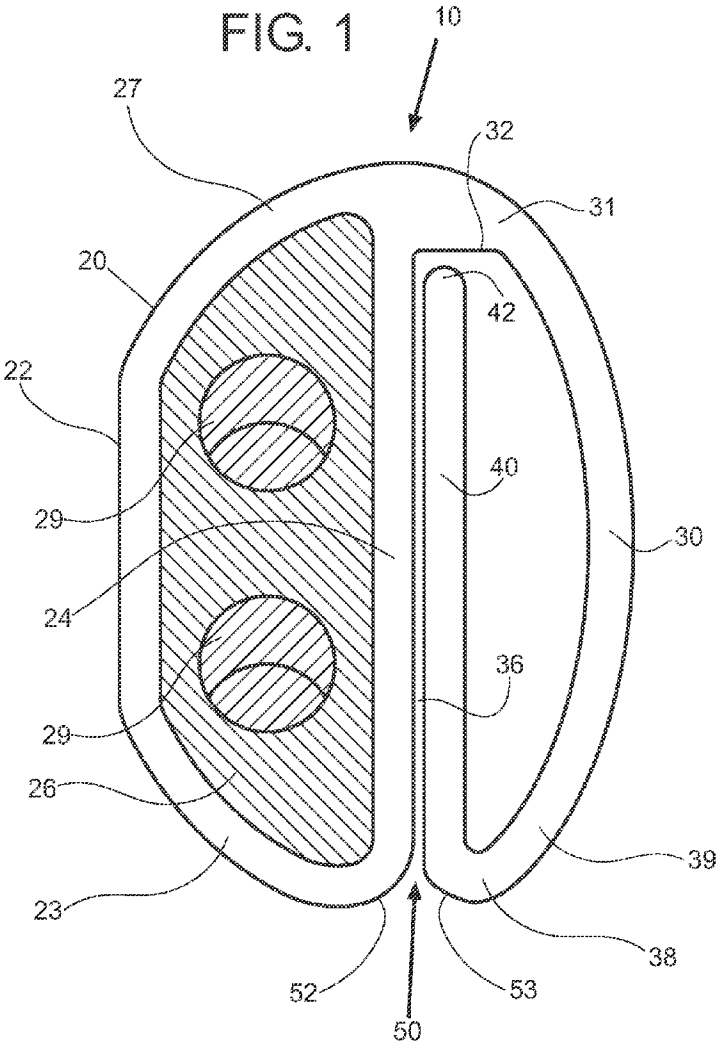
FIG. 1 shows a front view of the preferred embodiment of the present invention.

A preferred embodiment of the present invention is illustrated in FIG. 1 which shows a front view of the removably attachable Knife Swiper 10. This view does not show fillets, which would preferably be placed on all edges, as described herein. A back view would be mostly identical to this front view, but reversed. Specific dimensions, proportions, and descriptions are provided for the preferred embodiment, however these are provided as examples only and may vary according to many factors, such as the size and shape of the device and the knife it is intended to be used on, as well as differing applications and usage.

Figure 1A:
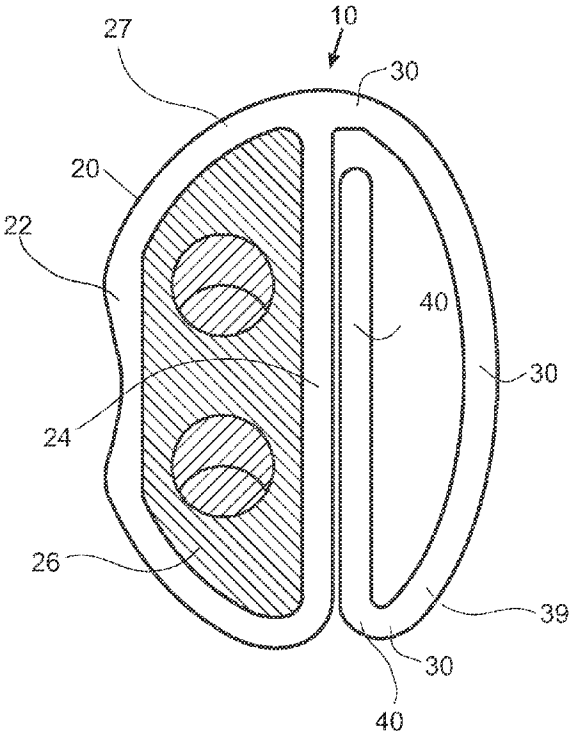
FIG. 1A shows a front view of a modified version of the preferred embodiment of the present invention.
Figure 3A:
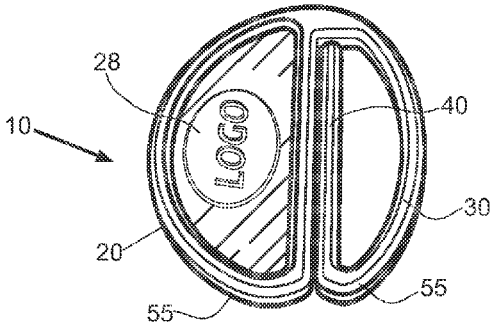
FIG. 3A shows a front perspective view of Swiper 10 with no Handle Indentation 22, and with an embossed logo.

Swiper 10 is mostly flat, preferably with a thickness of approximately 5 mm, and with recesses in the handle. Swiper 10 is comprised of Handle 20 that has an Outer Handle Ridge 27 which circumvents Handle 20, and defines Finger Recess 26. The inner portion of Outer Handle Ridge 27 comprises a mostly vertical Handle Wiper 24. Finger Recess 26 is a recess that is formed within Handle 20, and which helps the user grip the device more securely. In this manner, Outer Handle Ridge 27 helps prevent users' fingers from sliding off Handle 20. Handle Indentation 22 is an indented substantially straight section that is mostly centered on the outer portion of Handle 20. Swiper 10 can be made without Handle Indentation 22, as shown in FIG. 3A, and alternatively Handle Indentation 22 may be shaped differently, such as with two or more protrusions, as shown in FIG. 1A. Two protrusions would serve a similar purpose to a straight Handle Indentation 22, namely to elevate a portion of a utensil that the present invention is removably attached to, as described herein.

A Shoulder 31 protrudes outward from the top of Handle 20. Protruding mostly downward from Shoulder 31 is Arm 30, which ends in Connector 38. Protruding upward mostly vertically from Connector 38 is Wiper 40, which ends in a Rounded Top 42. Shoulder 31 has as its bottom a Straight Bottom 32. Straight Bottom 32 should be a minimum length, depending on the height of Swiper 10 and the size of the blade it will be used on, to help prevent binding of Swiper 10 on the knife when slid along the knife blade. A minimum of 6 mm is recommended for the Straight Bottom 32 for a Swiper 10 of total 55 mm height. Less than 6 mm can be used for a shorter Swiper 10. As shown in FIG. 1A, Swiper 10 may not have a defined Shoulder 31 and/or Connector 38, instead having arm 30 protrude directly from the top portion of Handle 20, and Wiper 40 protruding directly from the end portion of Arm 30.

Swiper 10 may incorporate various methods and designs to facilitate a better grip by the user. For example, Finger Recess 26 may be textured, ribbed, etc. It may be overmolded with a material that provides more comfort and/or better grip to the user. It may have protrusions and/or engravings. Shown here are two Grip Assistors 29 which outwardly protrude from Finger Recess 26. For marketing purposes, an embossed logo may be placed on Finger Recess 26, as shown in other embodiments, and which may also provide a better grip for the user.

A Gap 36 is formed between Wiper 40 and Handle Wiper 24. Gap 36 accommodates the insertion of the blade of a knife into Swiper 10, and is preferably no more than 1 mm wide. Connector 38 and Handle 20 have at their bottoms an Arm Entrance 53 and Handle Entrance 52 respectively. These are rounded corners which form Knife Entrance 50, an opening which helps guide the knife blade into Gap 36. The radius, angle and height of Arm Entrance 53 and Handle Entrance 52 may be modified for easier insertion onto various shapes and sizes of knives, as well as other utensils.

Swiper 10 is preferably made from a material that facilitates the flexible movement of Wiper 40 and Arm 30, for example but not limited to injection-molded polypropylene. The width of Arm 30, Connector 38, and Wiper 40 should be optimized for the material it will be made of, whereby there is sufficient flexibility to allow easy placement of Swiper 10 on a knife blade, sufficient friction to substantially keep Swiper 10 on the knife blade once it is placed there and while slicing ingredients, as well as the easy sliding of Swiper 10 along the knife blade during use. Sizes and thickness of Swiper 10 and its parts may vary based on the size of the knife or other utensil it is made to be used with, and other considerations such as the weight of the knife or other utensil and other usage considerations.

In the preferred embodiment, Swiper 10 is 5 mm thick, with at least a 1 mm radius fillet on every outer edge. A suitable thickness should be used to prevent the device from buckling under the weight of a knife when a knife with Swiper 10 attached to it is placed down on a surface. For smaller versions of Swiper 10 that may be used with smaller knives, less thickness may be used. Additionally, the device should not be too thick, as binding may then be more likely to occur. The Finger Recess 26 is recessed 1.5 mm on each side of Handle 20. The width of Arm 30 is 3.5 mm, the width of Wiper 40 is 3 mm, as is the width of Outer Handle Ridge 27 and Handle Wiper 24. Arm 30 should be wider than Wiper 40 so that Wiper 40 will stay bent along blade 64 when the device is attached to a knife, while Arm 30 stays less bent. Connector 38 tapers from the width of Arm 30 to the width of Wiper 40. Handle Indentation 22 is preferably at least 25 mm long, is mostly centered on Handle 20, and mostly vertical. Handle Indentation 22 may be angled. The amount of this angle depends on the thickness of Arm 30 and Wiper 40; the thicker they are, the more of an angle may be used, as described presently in Variation A.

From a front view, the angle between the Outer Bottom Portion 23 of Handle 20 and Handle Wiper 24 is an acute angle, as is the angle formed between the Outer Bottom Portion 39 of Arm 30 and Wiper 40. Acute angles herein allow users to generally cut food at a natural angle while the present invention is attached to their knife, whereby the present invention will not interfere with cutting and slicing with the knife. If any interference does occur, the user may lift Swiper 10 slightly upwards on the knife blade.

Although the height of handle 20 may vary to the height of Shoulder 31 plus Arm 30 plus Connector 38, preferably they are mostly similar, and close to the height of the knife blade they will be attached to, which may also vary. The width of handle 20 may vary, but should be sufficiently long enough to be easily and firmly grasped by the fingers of a human hand, to facilitate easy attachment and removal of the device, as well as the safe and easy sliding of the device along a blade surface. The corners of handle 20 are preferably rounded so as not to gouge a cutting surface during use or interfere with cutting while the device is attached to a knife.

I presently prefer the body of the present invention to be made of injection molded plastic that will not scratch knives, has strong material strength, is safe for use with food products, is dishwasher safe, and has flexible and elastic qualities, for example polypropylene. The present invention may be made of other suitable material or materials, for example HDPE, styrene, and spring stainless steel.

OPERATION

Preferred Embodiment

FIGS. 4A-6B

Figure 4A:
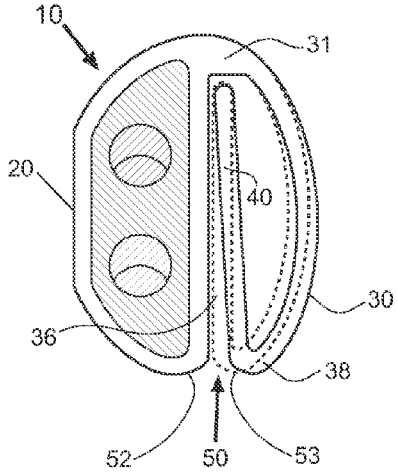
FIG. 4A shows a front view of the present invention showing Arm 30 being pushed outward at Shoulder 31.
Figure 4E:
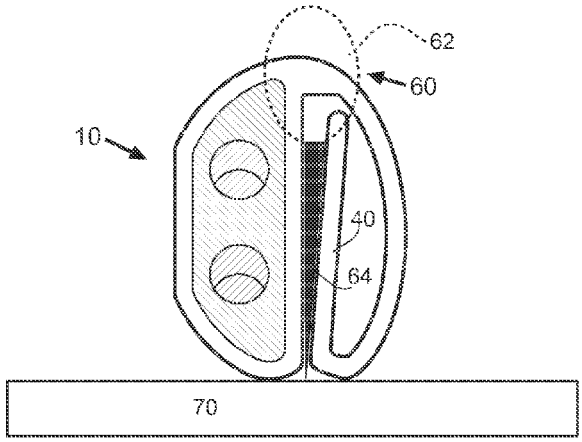
FIG. 4E shows a front view of the present invention showing how Knife Swiper 10 self-adjusts height-wise on Knife Blade 64 when user first cuts with Knife 60 on a cutting surface such as Cutting Board 70.
Figure 5A:
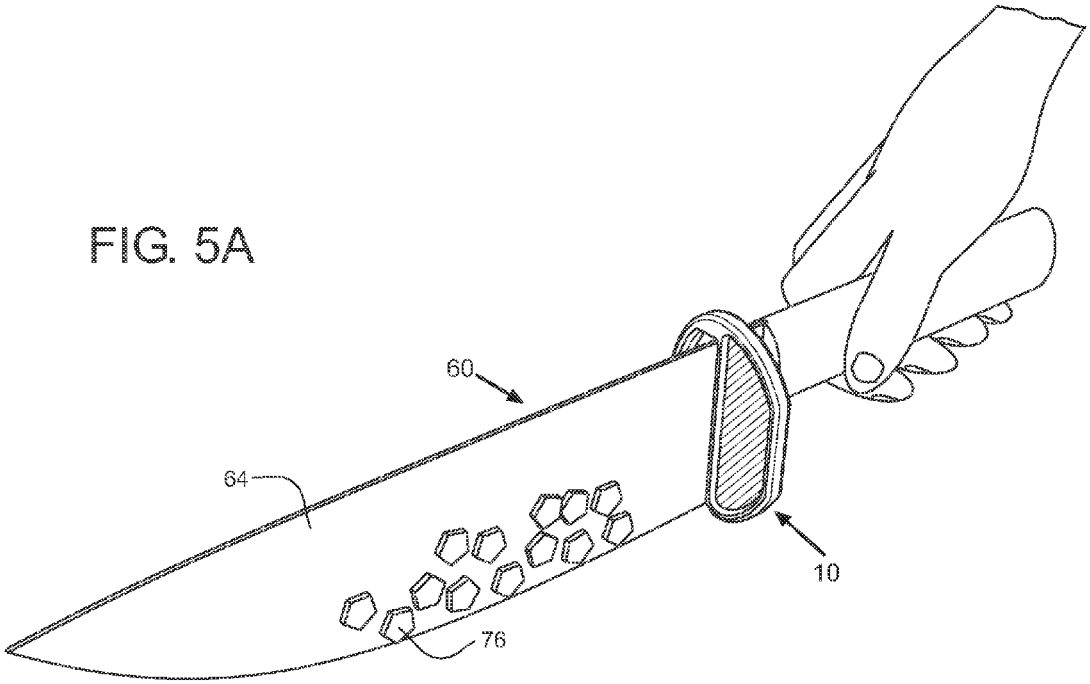
FIG. 5A shows a perspective view of the present invention removably attached to a knife that has food remnants stuck to its blade.

In operation one uses the present invention by removably attaching it to a knife or other cutting utensil, or any other suitable utensil. Typically, Swiper 10 is placed towards the back of knife blade 64, close to knife handle 62. Swiper 10 is placed upright onto blade 64 of knife 60 so that Handle Wiper 24 and Wiper 40 are adjacent opposite sides of blade 64, as shown in FIGS. 4E and 5A. Friction between Handle Wiper 24, Wiper 40, and blade 64 removably holds Swiper 10 in place on the knife, as a spring clip is created by the device, forcefully sandwiching blade 64 between Handle Wiper 24 and Wiper 40. Handle Wiper 24 and Wiper 40 may be temporarily pressed away from knife blade 64 during use, but will spring back into place against the blade when released. The Rounded Top 42 of Wiper 40 allows Wiper 40 to flex further outward, as well as facilitate the easy donning and doffing of the device.

Figure 4B:
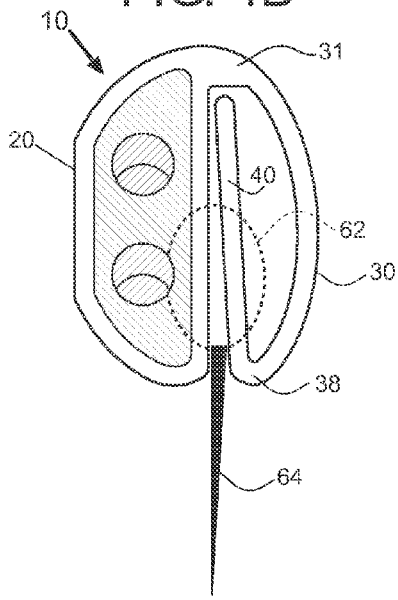
FIG. 4B shows a front view of the present invention showing Arm 30 being pushed outward from Shoulder 31 when Knife Swiper 10 is first placed onto Knife Blade 64.
Figure 4C:
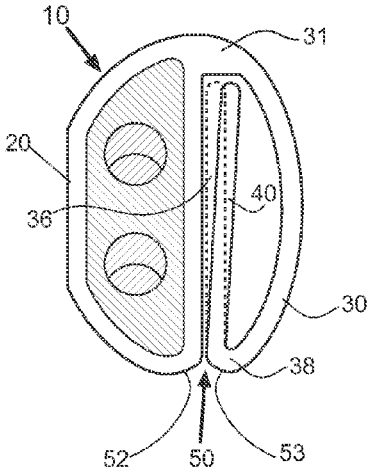
FIG. 4C shows a front view of the present invention showing Wiper 40 being pushed outward from Connector 38.
Figure 4D:
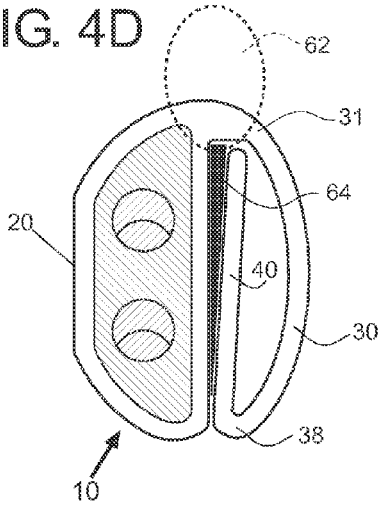
FIG. 4D shows a front view of the present invention showing Wiper 40 being pushed outward from Connector 38 when Knife Swiper 10 is fully placed onto Knife Blade 64.

Placement is accomplished by placing Knife Entrance 50 of Swiper 10 onto the top of knife blade 64 and pushing downwards onto the blade as shown in FIG. 4B. FIG. 4A shows how during this process Connector 38 and Arm 30 are pushed outwards to accommodate the blade 64, by increasing the lower width of Gap 36. The user continues pushing Swiper 10 downward on blade 64, whereby Connector 38 and Arm 30 move back inward while Wiper 40 is pushed outward by the top portion of knife blade 64, as shown in FIGS. 4C and 4D. The design of Knife Entrance 50 facilitates fast, easy, and proper placement of the device on a knife blade; Handle Entrance 52 and Arm Entrance 53 guide the top of the knife blade into the device, while at the same time gradually opening Gap 36 for the entering blade 64.

Because Wiper 40 is attached to the bottom of Arm 30 at Connector 38, and pivots there, Wiper 40 will maintain contact substantially along its entire length with the side of blade 64. The advantage of this design is that Wiper 40 pivots at its bottom, whereby the angle that it is pushed outward matches the angle of the knife blade, as does the angle of Handle Wiper 24, whereby the device is more effective at cleaning the blade. If Wiper 40 was connected instead to Shoulder 31, such full contact would likely not take place, because of the variation in the size, shape, and thickness of different knife blades. The present invention, on the other hand, because of the bottom pivot, will maintain more full contact with the sides of the blade, as shown in FIG. 4D.

FIG. 4E shows Swiper 10 attached to knife 60 on a cutting board 70, showing how the device, being slidable upwards, self-adjusts height-wise to effectively work on knives of all heights and sizes. If the bottom of Swiper 10 is lower than the bottom edge of blade 64 after the device has been removably attached to a knife, Swiper 10 will automatically slide upwards on blade 64 when the bottom of Swiper 10 comes into contact with a surface such as cutting board 70, thereby keeping the bottom of Swiper 10 generally level with the bottom edge of knife blade 64 to maintain efficiency of the device. Additionally, the shape of the bottom of the device, being acute angles as described above, allow users to cut at an acute angle while using the present invention while it is removably attached to a knife.

Swiper 10 may be placed with handle 20 on either side of knife blade 64, typically depending on the handedness and preferences of the user. Swiper 10 can also be placed upside down on knife blade 64, whereby the device is placed over the sharp edge of the knife, but this is not optimal. Swiper 10 can be placed elsewhere on the blade, for example the front of knife blade 64.

With Swiper 10 removably attached to knife 60, the user cuts food as they normally would with the knife, typically utilizing a cutting surface such as a cutting board 70, chopping mat, butcher block, etc.

Figure 5B:
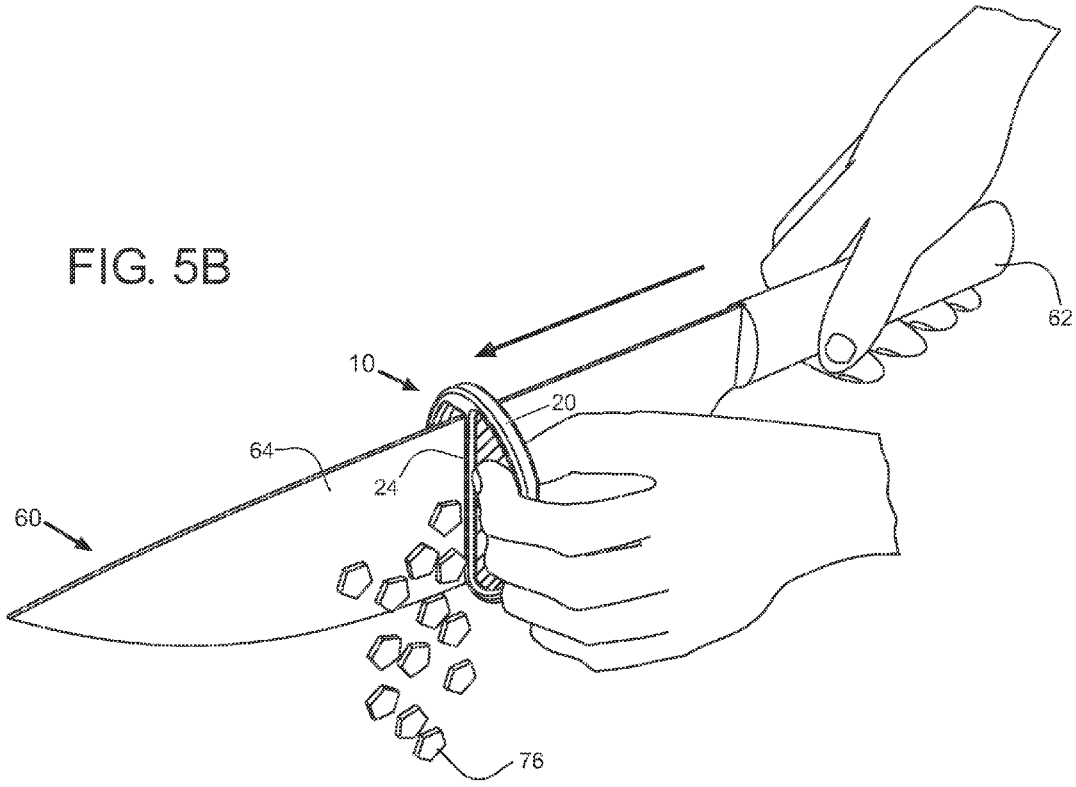
FIG. 5B shows a perspective view of the present invention being used to remove food remnants from a knife blade.
Figure 5C:
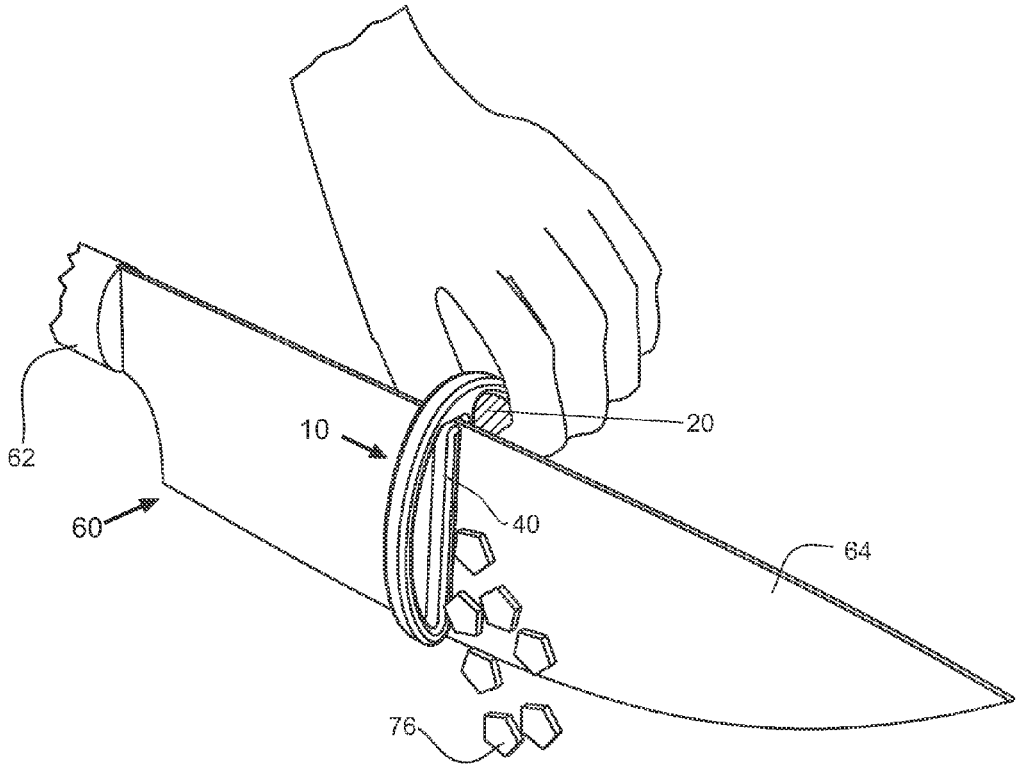
FIG. 5C shows a different perspective view of the present invention being used to remove food remnants from a knife blade, showing how both sides of the knife blade are cleaned in a single swipe of the present invention.

Swiper 10 facilitates the fast, easy, and safer removal of food remnants 76 that may get stuck to knife blade 64 after slicing, as shown in FIG. 5A. To remove food stuck to knife blade 64, user grasps Handle 20 and slides Swiper 10 lengthwise along the length of blade 64, typically in the direction of the arrow, whereby Handle Wiper 24 and Wiper 40 push food remnants 76 off both sides of knife blade 64, as illustrated in FIGS. 5B and 5C. The user then replaces Swiper 10 to its starting position on knife blade 64, so they may continue cutting food.

FIG. 6A shows the advantage of the Straight Bottom 32 of Shoulder 31. Because Straight Bottom 32 is straight and of a minimum length, here being 6 mm, it helps prevent Swiper 10 from binding on the knife blade 64 during use, especially when the device is tilted forward or backward during use, as shown in FIG. 6A. The minimum length of Straight Bottom 32 allows the device to continue sliding forward along blade 64 without the top of the blade getting sandwiched between the inner part of Arm 30 and Handle Wiper 24, which would cause excessive friction along the blade. Generous Fillets 55 on all outer edges of the device also assist in preventing binding on a blade, as shown in FIG. 3A, which shows Swiper 10 with no Handle Indentation 22. A minimum of 1 mm radius is recommended. Chamfers or bevels on the outside edges can alternatively be used. The thickness of the device also plays a part in preventing binding. The thinner the device, the less binding occurs. Lowering the height of Wiper 40 will also help prevent binding.

Users may also wipe-off the blade by removing Swiper 10 from blade 64 and using the straight parts of Handle 20 or Arm 30, if any, for example with Handle Indentation 22 or Straight Arm 34, to wipe off food remnants from the blade. Swiper 10 may then be returned to its starting position to continue food preparation. If the user prefers not to attach the device to a knife in the first place, they may instead keep the device close by, picking it up and using Handle Indentation 22 or Straight Arm 34 to wipe food remnants off a blade when necessary.

Straight Bottom 32 also helps guide Swiper 10 along knife blade 64 by traveling adjacently to and along the top edge of knife blade 64. This is especially advantageous if the user is holding knife 60 with their dominant hand while using their non-dominant hand to slide Swiper 10 along knife blade 64. Because Straight Bottom 32 typically slides along the top of the knife blade, the device is guided along the length of the blade with minimum effort required for guiding by the user, providing excellent accuracy. Outer Handle Ridge 27 as well as Grip Assistors 29 help keep the user's fingers firmly and securely on the device.

Figure 2A:
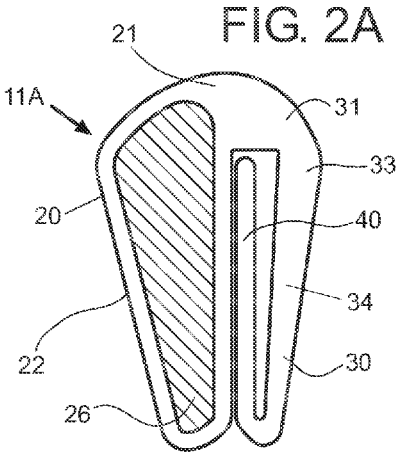
FIG. 2A shows a front view of Variation A of the present invention.
Figure 2C:
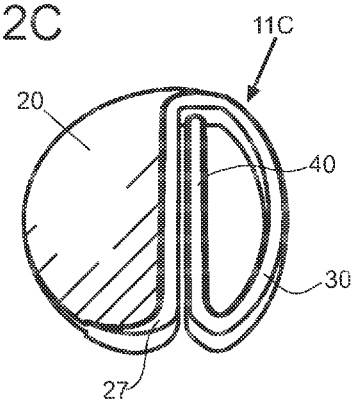
FIG. 2C shows a front perspective view of Variation C of the present invention.
Figure 2B:
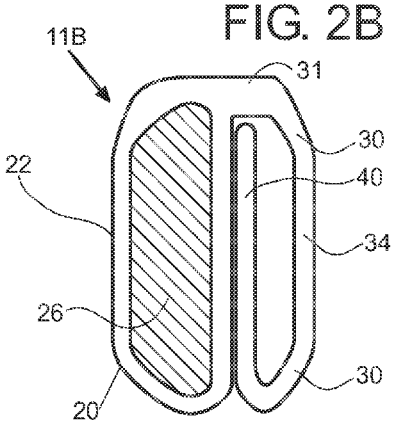
FIG. 2B shows a front view of Variation B of the present invention.
Figure 2D:
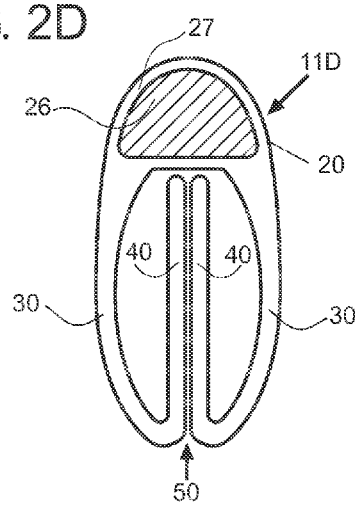
FIG. 2D shows a front view of Variation D of the present invention.

Finally, with Swiper 10 in place, knife 60 may be placed down on a surface with handle 20 facing the surface, whereby knife handle 62 and the Handle Indentation 22 portion of Swiper 10 rest on the surface of a work area, counter, cutting board 70, etc., keeping blade 64 elevated off the surface, as illustrated in FIG. 6B. This helps to keep work surfaces cleaner and keeps the knife blade from getting contaminated by whatever may be on that surface. Additionally, by keeping a knife in this position, it is faster and easier to pick up than when it is placed down flat on its side without a Swiper 10 attached. The angle of Handle Indentation 22 and Arm 30 can vary in order to tilt the blade so that the blade's sharp edge points downwards. Additionally, any section of Swiper 10 that is suited for the purpose may be used to keep a knife in an upright position, for example straight sections at the top of the device, as shown in FIG. 2B, and straight sections of Arm 30, as shown in FIGS. 2A and 2B.

Another use for the Knife Swiper 10 is as a food gathering and moving device while not attached to a knife Some people push cut-up food onto a knife blade with their fingers and hands, so that they can carry the food to another location. Swiper 10 may be used to push the food onto the blade instead. When the user is finished using Swiper 10, it is removed from Knife 60 for suitable washing and storing.

DESCRIPTION

Alternative Embodiment A

FIG. 2A

There are many possibilities for alternative and additional embodiments of the present invention. For example, Alternative Embodiment-A 11A shows the present invention with an angled Handle Indentation 22, an angled and tapered Straight Arm 34, a Wide Upper Arm 33, an Upwardly Extending Handle 21, and a higher Shoulder 31.

OPERATION

Alternative Embodiment A

FIG. 2A

Embodiment-A 11A is removably attached to knife 60 and used in a similar manner as the preferred embodiment as described above. Upwardly Extending Handle 21 allows the user to grasp Embodiment-A 11A more towards the top the device, as well as at the side, as per their preference. Knife 60 may be put down onto a surface resting on either the Handle Indentation 22 or Arm 34 of Embodiment-A 11A, whereby the knife blade will be consequently angled downwards, so that the sharp end of the blade also points downwards. Wide Upper Arm 33 helps to facilitate the knife not sliding out of Embodiment-A 11A when at this increased angle by placing more pressure, and thereby creating more friction, between the device and the knife blade.

DESCRIPTION

Alternative Embodiment B

FIG. 2B

Alternative Embodiment-B 11B shows the present invention with a substantially vertical Handle Indentation 22, and a substantially vertical Straight Arm 34, with rounded upper and lower portions. Additionally, shoulder 31 is substantially flat.

OPERATION

Alternative Embodiment B

FIG. 2B

Embodiment-B 11B is removably attached to knife 60 and used in a similar manner as the preferred embodiment as described above. When Knife 60 is put down onto a surface resting on the longer, substantially vertical Handle Indentation 22 of Embodiment-B 11B, Handle Indentation 22 facilitates Knife 60 resting lower and more stable on a surface.

Additionally, while Embodiment-B 11B is removably attached to a knife, the knife may be placed down on a surface so that it rests on the substantially vertical Straight Arm 34 of Embodiment-B 11B.

FIG. 2B shows the versatility of the present invention and how it may be designed so that it can hold a knife in a several different positions on a surface, according to user preference, by placing either straight surfaces or parallel protrusions in several places on the device. For example, shoulder 31 may be mostly flat or with two or more parallel protrusions on it, whereby the knife is placed on a surface with shoulder 31 coming into contact with the surface, thus holding the knife mostly vertical. Similarly, the bottom of handle 20 and/or connector 38 may be shaped so that it will hold a knife mostly upright when the knife is placed on a surface with the bottom of handle 20 and/or connector 38 contacting the surface. Additionally, if the present invention is made with arm 30 having a straight portion, the knife may be placed on a surface with the straight portion of arm 30 coming into contact with the surface, thus holding the knife mostly horizontal. Further, the device may be placed upside down on a knife blade, whereby shoulder 31 comes into contact with the sharp edge of knife blade 64.

DESCRIPTION

Alternative Embodiment C

FIG. 2C

Alternative Embodiment-C 11C shows the present invention with a truncated Outer Handle Ridge 27.

OPERATION

Alternative Embodiment C

FIG. 2C

Alternative Embodiment-C 11C is removably attached to knife 60 and used in a similar manner as the preferred embodiment as described above. The truncated Outer Handle Ridge 27 allows potentially faster and easier grasping of Handle 20. Truncated Outer Handle Ridge 27 has a lower portion that continues around Handle 20 for a sufficient distance that is enough to help prevent a user's fingers from slipping off of the device during use. Grip assistors 29 may be added, as well as other methods of facilitating a better grip on Handle 20, may be utilized.

DESCRIPTION

Alternative Embodiment D

FIG. 2D

Alternative Embodiment-D 11D shows the present invention with two opposing Shoulders 31, Arms 30, and Wipers 40. Its Handle 20 is above the two Shoulders 31. It may incorporate any of the variations shown in this application, for example it may have straight arms 30 or a Handle Indentation 22 in one or both of its arms 30 and/or handle 20.

OPERATION

Alternative Embodiment D

FIG. 2D

Alternative Embodiment-D 11D is removably attached to knife 60 and used in a similar manner as the preferred embodiment as described above. The Handle 20, located at the top of the device, allows users to grasp Swiper 10 from the top of the device. This version also provides the advantage of easier insertion on a knife, since both arms 30 and both wipers 40 can move to accommodate the insertion of a knife blade.

Advantages

From the description above, a number of advantages of my multifunctional Knife Swiper become evident:

(a) The present invention facilitates faster, easier, safer and more enjoyable removal of food remnants that have stuck to a knife blade after cutting, by providing a convenient device for sliding along the blade to remove the stuck food, whereby the user avoids touching the blade with their fingers, and avoids touching cut-up food that could cause bacterial contamination, and cause strong odors and skin irritants from such foods as onion, garlic, and pepper to get on their skin. Additionally, by facilitating faster preparation of foods such as onions, the user has less exposure to the eye irritants contained therein, thereby making food preparation a more pleasant experience;

(b) The present invention facilitates faster, easier, and cleaner food preparation by providing means for a knife to rest with its blade elevated off countertops and other work surfaces when put down between use, thereby keeping the knife blade off surfaces. This keeps surfaces cleaner and helps prevent contamination of the blade by dirt or germs on that surface. Additionally, by keeping a knife upright, it is faster and easier to pick up than if the knife was placed down on its side without the present invention attached to it;

(c) The present invention will removably attach to and fit most knives and work effectively on most knife shapes and styles. The present invention can be placed with its handle on either side of a knife blade for use by right-handed and left-handed users, and can be used with either hand, so that the user does not have to switch the knife to their non-dominant hand in order to use the device;

(d) The present invention is easy to use, easy to learn how to use, and makes cooking more enjoyable and less frustrating. It allows the user to generally maintain their present cutting method and style while using the device. It is easily cleaned by hand or in a dishwasher. It acts as a splash guard when cutting juicy fruits and vegetables, and has a long product life;

(e) The present invention effectively cleans off both sides of a knife blade with just a single swipe by the user.

(f) The present invention will maintain maximum contact with both sides of many shapes and sizes of knife blades, which is facilitated by the wiper (40) rising upwards from the bottom of the device.

(g) The present invention conveniently stays on a knife blade while the user cuts their food as they normally would. It stays unobtrusive and out of the way until the user wishes to clean their blade, and allows the user to angle the knife while cutting.

CONCLUSION, RAMIFICATIONS, AND SCOPE

Accordingly the reader will see that, according to the present invention, I have provided a removably attachable Knife Swiper for a utensil such as a kitchen knife that allows the user to cut food items as they normally do, and providing several benefits to the user, including but not limited to providing means to quickly and safely remove food remnants that are stuck to the blade of the knife, and providing means for the knife to rest on a surface so that its blade is elevated off the work surface. Furthermore, the present invention has the additional advantages that:

a. It can be made with various materials and/or coated with Teflon, PTFE, or other non-stick coatings, as well as other coatings to provide various benefits, such as making it slide more easily along a knife blade, and to help prevent food from sticking to the device;

b. It can be used without first removably attaching it to a utensil, by picking it up from its resting place for immediate use;

c. It can have a knife sharpener or other particular shape and material incorporated into the device that the user can use to sharpen the blades of their knives;

d. Various methods may be implemented to make Swiper 10 and any embodiment thereof easier for the user to grip and use, for example handle 20 can be textured, ridged, coated, over-molded, grooved, engraved, with inverted or sunken areas, etc.;

e. It can be made in many shapes and sizes to accommodate many different utensils;

f. The shoulder, arm, and/or wiper may be a different thickness than the handle. For example, wiper 40 may be made less thick in order to help prevent the binding of the device on a knife blade during use.

g. It can be used as a food gathering and moving device.

h. A magnet or other attachment means may be used to assist the removable attachment of the device onto a knife.

While the above description contains many specificities, these should not be construed as limitations on the scope of the invention, but as exemplifications of the presently preferred embodiments thereof. Many other ramifications and variations are possible within the teachings of the invention. For example, it can be made in many shapes and sizes to accommodate usage on various shapes, styles, and sizes of knives and other cutting tools, for use in the kitchen and elsewhere, as well as other utensils and scrapers. It can be used to scrape things other than food, it may be used to assist in cleaning a knife blade after use, and may be used to scrape items other than knife blades.

Thus the scope of the invention should be determined by the appended claims and their legal equivalents, and not by the examples given.

What is claimed is:

1. A cleaning device removably attachable to the blade of a knife, the device comprising:

(a) an elongated handle with a shoulder portion laterally extending from a top portion thereof, the handle defining an elongate handle wiping edge extending from a bottom portion to the top portion thereof;

(b) an arm extending downward from the shoulder portion;

(c) an elongate wiper extending from a bottom portion of the arm toward the shoulder portion at the top portion of the handle, the wiper and the arm defining a space between them and facing surfaces of the wiper and the handle wiping edge defining a gap for receiving the blade of the knife; and (d) whereby debris located on the blade may be removed by sliding the device along the length of the blade while the opposed facing wiping surfaces are engaged with the sides of the blade.

2. A cleaning device removably attachable to the blade of a knife, the device comprising:

(a) a handle member having opposed ends;

(b) a pair of spaced elongated arms extending downward from respective ends of the handle member;

(c) a pair of spaced elongated wipers extending upward from respective lower ends of the arms, the wipers and the respective arms defining a space between them and facing surfaces of the wipers defining a gap for receiving the blade of the knife; and (d) whereby debris located on the blade may be removed by sliding the device along the length of the blade while the facing surfaces of the wipers are engaged with the sides of the blade.

* * * * *